US006054800A

United States Patent [19]

Joo et al.

[11] Patent Number: 6,054,800

[45] Date of Patent: Apr. 25, 2000

[54] CATHODE FOR AN ELECTRON GUN

[75] Inventors: Gyu-Nam Joo; Jong-Seo Choi; Yoon-Chang Kim, all of Suwon-shi, Rep. of Korea

[73] Assignee: Samsung Display Devices Co., Ltd., Rep. of Korea

[21] Appl. No.: 09/063,945

[22] Filed: Apr. 21, 1998

[30] Foreign Application Priority Data

Dec. 30, 1997 [KR] Rep. of Korea ..... 97-79086

[51] Int. Cl.[7] ..... H01J 1/94

[52] U.S. Cl. ..... 313/270; 313/346 R; 313/346 DC

[58] Field of Search ..... 313/346 R, 346 DC, 313/270, 337, 355

[56] References Cited

U.S. PATENT DOCUMENTS

| | | | |
|---|---|---|---|
| 4,291,252 | 9/1981 | Aida et al. | 313/346 R |
| 4,404,492 | 9/1983 | Patty | 313/346 R |
| 4,471,260 | 9/1984 | Hasker et al. | 313/346 R |
| 4,924,137 | 5/1990 | Watanabe et al. | 313/346 R |
| 5,059,856 | 10/1991 | Derks | 313/346 R |
| 5,075,589 | 12/1991 | Derks et al. | 313/346 R |
| 5,118,984 | 6/1992 | Saito et al. | 313/346 R |
| 5,146,131 | 9/1992 | Derks | 313/346 R |
| 5,347,194 | 9/1994 | Derks | 313/346 DC |
| 5,592,043 | 1/1997 | Gartner et al. | 313/346 DC |
| 5,698,937 | 12/1997 | Ju et al. | 313/270 |

*Primary Examiner*—Ashok Patel
*Attorney, Agent, or Firm*—Baker & McKenzie

[57] ABSTRACT

The present invention discloses a cathode for an electron gun comprising a base metal mainly composed of nickel and containing one kind of reducing element at least, a metal layer mainly composed of tungsten, tungsten-nickel, or zirconium-tungsten on the upper side of the base metal, and an electron emitting material layer containing alkaline earth metal oxide including barium at least on the upper side of the metal layer. The metal layer is formed by spreading tungsten, tungsten-nickel, or zirconium-tungsten on the base metal and heating it to have particle smaller than that of the base metal, to increase its life cycle under a high current density load by ensuring a diffusion route of reducing element steadily, used for good generation of free radical barium atom.

15 Claims, 6 Drawing Sheets

CATHODE FOR AN ELECTRON GUN

BACKGROUND OF THE INVENTION

1. Field of the Invention

The present invention relates to a cathode for an electron gun used in a cathode ray tube, and more particularly, it relates to a cathode for an electron gun for increasing its life cycle under a high current density load by ensuring a diffusion route of reducing element steadily, used for generating free radical barium atom.

2. Description of the Prior Art

A cathode ray tube is a device for forming an image by excitation light emission of a fluorescent material of a screen by landing an electron, emitted from an electron gun and accelerated by high voltage on the fluorescent material.

FIG. 5 is a general structural diagram of a cathode for an electron gun in a cathode ray tube.

In FIG. 5, the cathode comprises a heater 4 in a sleeve 2, a cap-formed base metal 6 mainly composed of nickel Ni and containing a small amount of reducing elements such as silicone Si and magnesium Mg on the upper side of the sleeve 2, and an electron emitting material layer 8 mainly composed of alkaline earth metal oxide containing barium at least on the cap-formed base metal 6.

In such a cathode, the metal oxide and the reducing element react to each other by heat generated from the heater to generate free radical barium atom, and thereafter thermion is emitted by using free radical barium atom. An electron emission capacity of the cathode for the electron gun is influenced by a supply amount of free radical barium contained in the metal oxide.

However, since the cathode ray tube has a tendency of enlargement and high precision recently, a cathode which can supply free radical barium atom for a long time in high current density is required.

In Korean patent laid-open No. 96-15634, a cathode restraining free radical barium atom from evaporating by adding both of lanthanum La compound and magnesium compound Mg or La—Mg mixed compound to the electron emitting material layer containing alkaline earth metal oxide is disclosed.

However, in the conventional cathode, an intermediate layer 10 is generated in a boundary between the base metal 6 and the electron emitting material layer 8 by reaction as shown in FIG. 6, and it results to shorten the life cycle of the cathode under high current density load of 2~3 A/cm$^2$.

The intermediate layer 10 is generated by reaction of barium oxide pyrolized from barium carbonate and silicone or magnesium.

$$BaO+Mg \rightarrow MgO+Ba\uparrow \quad \text{[Reaction formula 1]}$$

$$4BaO+Si \rightarrow Ba_2SiO_4+2Ba\uparrow \quad \text{[Reaction formula 2]}$$

Free radical barium atom generated by the reaction formula 1 or 2 is served to emit electron, however, MgO or $Ba_2SiO_4$ is additionally generated by the same reaction formulas to generate the intermediate layer 10 in the boundary between the base metal 6 and the electron emitting material layer 8.

Such an intermediate layer 10 interferes the reaction for generating free radical barium atom requiring the reducing agent by obstructing diffusion of the reducing agent contained in the base metal 6, to shorten the life of the cathode.

In addition, since the intermediate layer 10 has a high resistance, it limits the current density possible to emit the electron by interfering flow of the electron emitting current.

In another aspect, a cathode for an electron gun comprising a metal layer which the reducing degree is same as or smaller than silicone or magnesium and larger than nickel between the base metal and the electron emitting material layer, and the electron emitting material layer containing rare earth metal oxide to decompose the compound generated from the reaction, and thereby enabling the reducing element in the metal layer to serve to generate free radical barium atom is disclosed in Japanese patent laid-open No. 91-257735.

However, the cathode described above is stable at the beginning but its life cycle is suddenly deteriorated with the lapse of time since the additional reaction compound is generated when free radical barium atom is generated.

SUMMARY OF THE INVENTION

Accordingly, the present invention is directed to a cathode for an electron gun that substantially obviates one or more of the problems due to limitations and disadvantages of the related art.

An object of the present invention is to provide a cathode for an electron gun for increasing its life cycle under a high current density load by ensuring a diffusion route of reducing element of a base metal steadily, used for good generation of free radical barium atom.

Additional features and advantages of the invention will be set forth in the description which follows, and in part will be apparent from the description, or may be learned by practice of the invention.

The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is disclosed a cathode for an electron gun comprising:

- a base metal mainly composed of nickel and containing one kind of reducing element at least;
- a metal layer mainly composed of tungsten, zirconium-tungsten or tungsten-nickel on the upper side of the base metal; and
- an electron emitting material layer containing alkaline earth metal oxide including barium at least on the upper side of the metal layer.

The metal layer is formed by spreading tungsten, zirconium-tungsten or tungsten-nickel on the upper side of the base metal and heating it to have particle smaller than that of the base metal.

In another aspects, the present invention provides a cathode for an electron gun further comprising a second electron emitting material layer containing both of lanthanum compound and magnesium compound or lanthanum-magnesium mixed compound in alkaline earth metal oxide containing barium at least on the upper side of the electron emitting material layer.

According to the present invention, since the metal layer having particle smaller than that of the base metal effectively disperses the material generated by the reaction of BaO and Si or Mg to ensure a diffusion route of the reducing element steadily, the reaction for generating free radical barium atom requiring the reducing element can be continued to increase life cycle of the cathode under high current density load of 2~3 A/cm$^2$.

BRIEF DESCRIPTION OF THE DRAWINGS

The accompanying drawings, which are included to provide a further understanding of the present invention and are incorporated in and constitute a part of this specification, illustrate embodiments of the present invention and together with the description serve to explain the principles of the present invention.

In the drawings.

DESCRIPTION OF THE PREFERRED EMBODIMENTS

Figure 1:
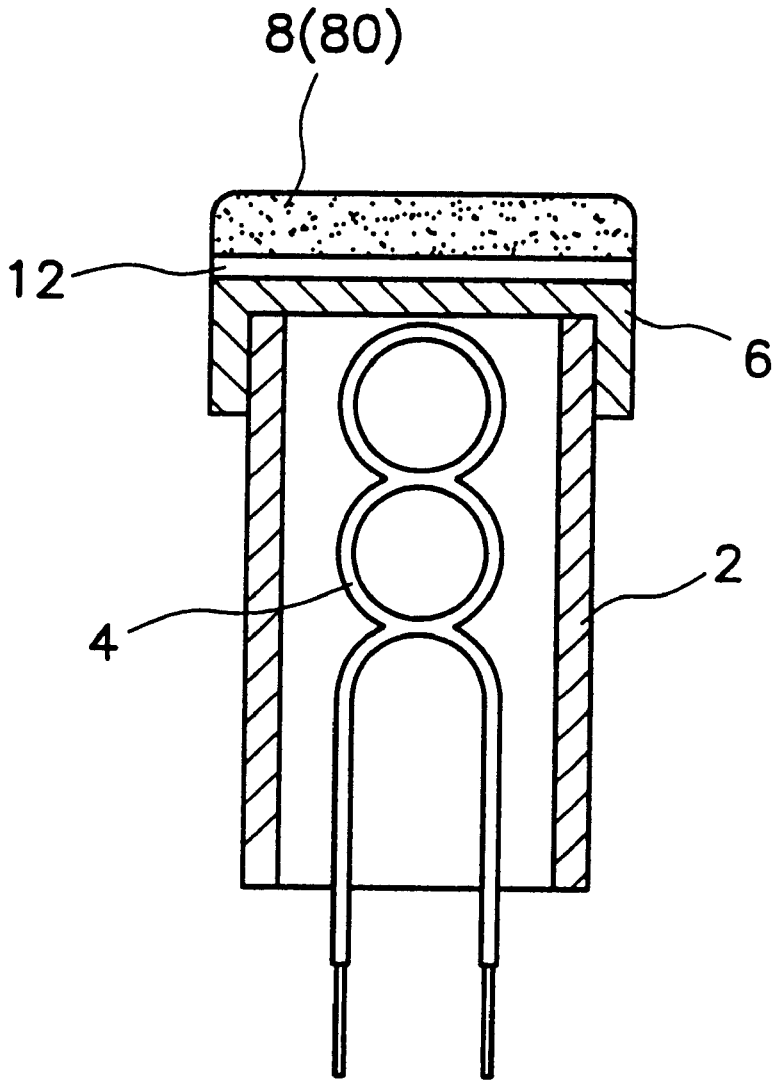
FIG. 1 is a sectional view of a cathode for an electron gun in accordance with one embodiment of the present invention.

Reference will now be made in detail to the preferred embodiments of the present invention, examples of which are illustrated in the accompanying drawings. Like reference numerals denote like reference parts throughout the specification and drawings.

EMBODIMENT 1

As shown in FIG. 1, a cathode for an electron gun according to a first embodiment of the present invention comprises a cap-formed base metal 6 mainly composed of Ni and containing reducing elements such as Si and Mg on upper opening portion of a sleeve 2 in which a heater 4 is mounted.

The cathode for the electron gun further comprises a metal layer 12 containing W, W—Ni, or Zr—W on the upper side of the base metal 6, and an electron emitting material layer 8 composed of alkaline earth metal oxide such as ternary carbonate $(Ba.Sr.Ca)CO_3$ or binary carbonate $(Ba.Sr)CO_3$ containing Ba at least on the upper side of the metal layer.

The metal layer 12 is obtained by forming a layer of W, W—Ni, or Zr—W to a thickness of 1,000~10,000 Å by sputtering, and heating it in the temperature of 700~1,100° C. in an inactive or vacuum condition to perform an alloying and diffusion between the base metal 6 and the metal layer 12.

The metal layer 12 is formed by adhering W, W—Ni, or Zr—W on the upper side of the base metal 6.

At this point, the adhesion is realized by physical, chemical, or mechanical methods such as spray, print, electrodeposition, metallic salt solution.

Figure 2:
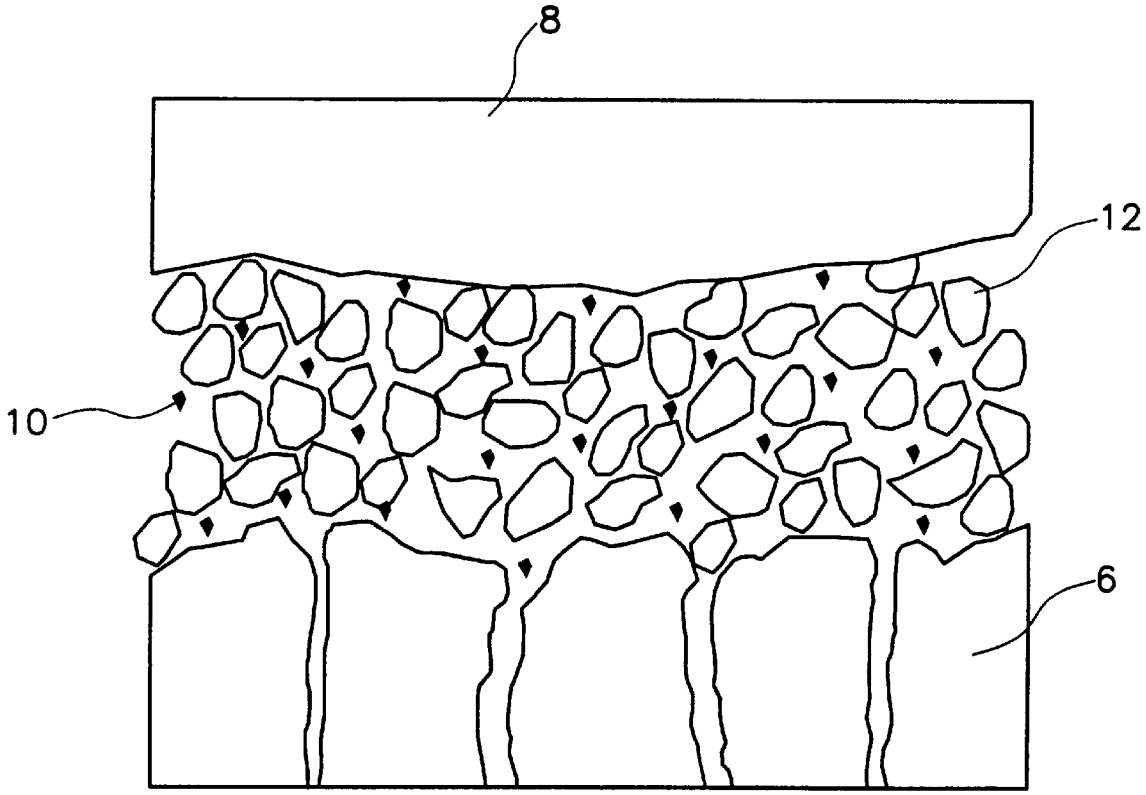
FIG. 2 is an enlarged sectional view of a main part of a cathode for an electron gun in accordance with one embodiment of the present invention.

Since the metal layer 12 according to the present embodiment is formed of particles smaller than those of the base metal 6 as shown in FIG. 2, the diffusion route of the reducing element contained in the base metal 6 is dispersed, and therefore, the reaction of BaO and Si or Mg is performed in many area of the metal layer 12, the intermediate layer 10 is restrained from being accumulated, and the reducing element such as Si and Mg is smoothly diffused to be served to generate free radical Ba atom.

The electron emitting material layer of ternary carbonate or binary carbonate is formed on the upper side of the metal layer 12 to the thickness of 20~80 μm by spray.

At this point, the thickness of the entire cathode must not exceed 200 μm.

EMBODIMENT 2

A second embodiment of the present invention proposes a cathode for an electron gun comprising a second electron emitting material layer instead of the electron emitting material layer of the first embodiment.

As shown in FIG. 1, the second electron emitting material layer 80 is formed on the upper side of the metal layer 12 composed of W, W—Ni, or Zr—W by adding both of La compound and Mg compound or La—Mg mixed compound in alkaline earth metal oxide such as ternary carbonate $(Ba.Sr.Ca)CO_3$ or binary carbonate $(Ba.Sr)CO_3$ containing Ba at least.

The La compound and Mg compound or La—Mg mixed compound restrains evaporation of free radical Ba atom to be continuously supplied. The weight of the La compound and Mg compound or La—Mg mixed compound is preferably 0.01~1 weight % of the carbonate.

When the weight there of carbonate is less than 0.01 weight %, the evaporation of free radical Ba atom can not be effectively restrained and when the weight thereof is more than 1 weight %, the electron emitting capacity at the beginning can be deteriorated.

According to the present embodiment, the intermediate layer 10 is effectively dispersed by the metal layer 12 and the evaporation of free radical Ba atom generated from the reaction of BaO and Si or Mg is restrained by the second electron emitting material layer 80.

The metal layer 12 according to the present embodiment is obtained by spreading W, W—Ni, or Zr—W to a thickness of 1,000~10,000 Å on the upper side of the base metal 6, and heating it in the temperature of 700~1,100° C. in an inactive or vacuum condition to perform an alloying and diffusion between the base metal 6 and the metal layer 12.

The second electron emitting material layer 80 composed of ternary carbonate or binary carbonate and further comprising both La compound and Mg compound or La—Mg mixed compound is formed on the upper side of the metal layer 12 to the thickness of 20~80 μm by spray coating.

At this point, the thickness of the entire cathode must not exceed 200 μm.

EMBODIMENT 3

Figure 3:
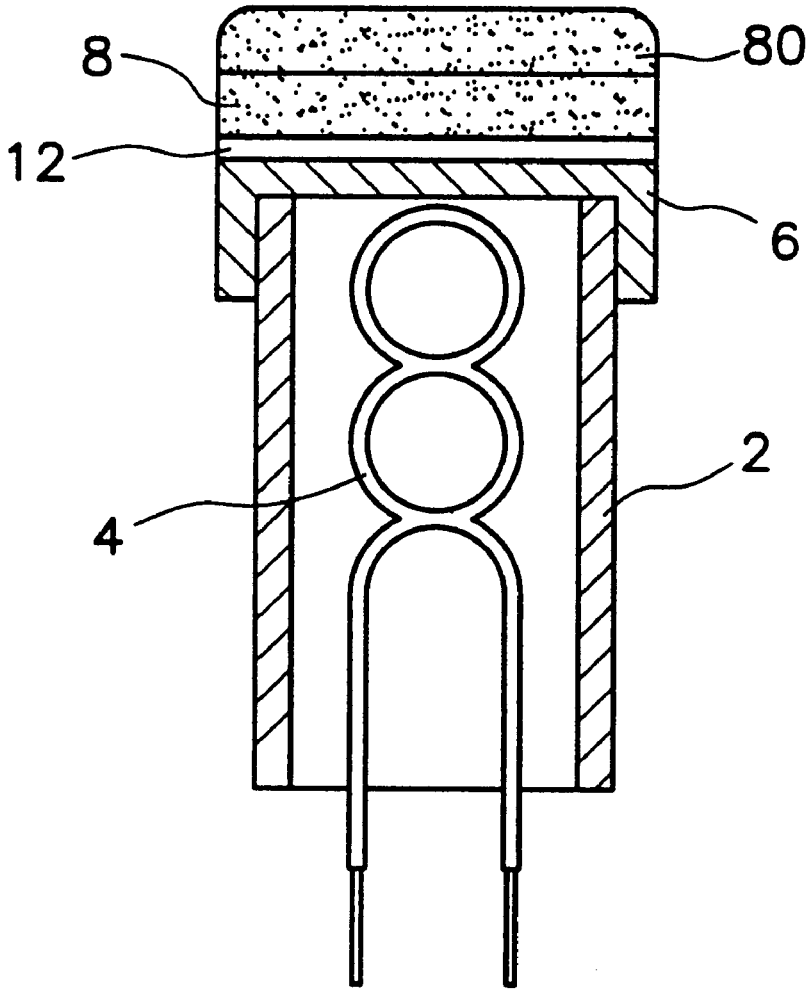
FIG. 3 is a sectional view of a cathode for an electron gun in accordance with another embodiment of the present invention.

As shown in FIG. 3, a cathode for an electron gun according to a third embodiment of the present invention comprises a base metal 6, a metal layer 12 composed of W, W—Ni, or Zr—W on the upper side of the base metal 6, an electron emitting material layer 8 composed of ternary carbonate or binary carbonate containing Ba at least on the upper side of the metal layer 12, and a second electron emitting material layer 80 composed of ternary carbonate or binary carbonate containing Ba at least and further containing both of La compound and Mg compound or La—Mg mixed compound on the upper side of the electron emitting material layer 8.

According to the second embodiment, free radical Ba atom may be excessively evaporated since the reducing element composed of W, W—Ni, or Zr—W and the reducing element contained in the base metal 6 urge the reduction of free radical Ba atom.

Accordingly, in the present embodiment, to disperse the material generated from the reaction of BaO pyrolized from carbonate and Si or Mg and accumulated in the boundary between the base metal 6 and the electron emitting material layer 8, the metal layer 12 containing W, W—Ni, or Zr—W is formed therebetween.

In addition, to restrain the evaporation of free radical Ba atom in the electron emitting material layer 8, the second electron emitting material layer 80 composed of carbonate containing 0.01~1 weight % of La compound and Mg compound or La—Mg mixed compound is formed.

The metal layer 12 is obtained by spreading W, W—Ni, or Zr—W to a thickness of 1,000~10,000 Å on the upper side of the base metal 6, and heating it in the temperature of 700~1,100° C. in an inactive or vacuum condition to perform an alloying and diffusion between the base metal 6 and the metal layer 12.

On the upper side of the metal layer 12, the electron emitting material layer 8 composed of ternary carbonate or binary carbonate is coated to the thickness of 20~80 μm, and on the upper side of the electron emitting material layer 8, the second electron emitting material layer 80 composed of ternary carbonate or binary carbonate and further containing both of La compound and Mg compound or La—Mg mixed compound is coated to the thickness of 20~80 μm in order to manufacture the cathode of the entire thickness does not exceed 200 μm.

Figure 4:
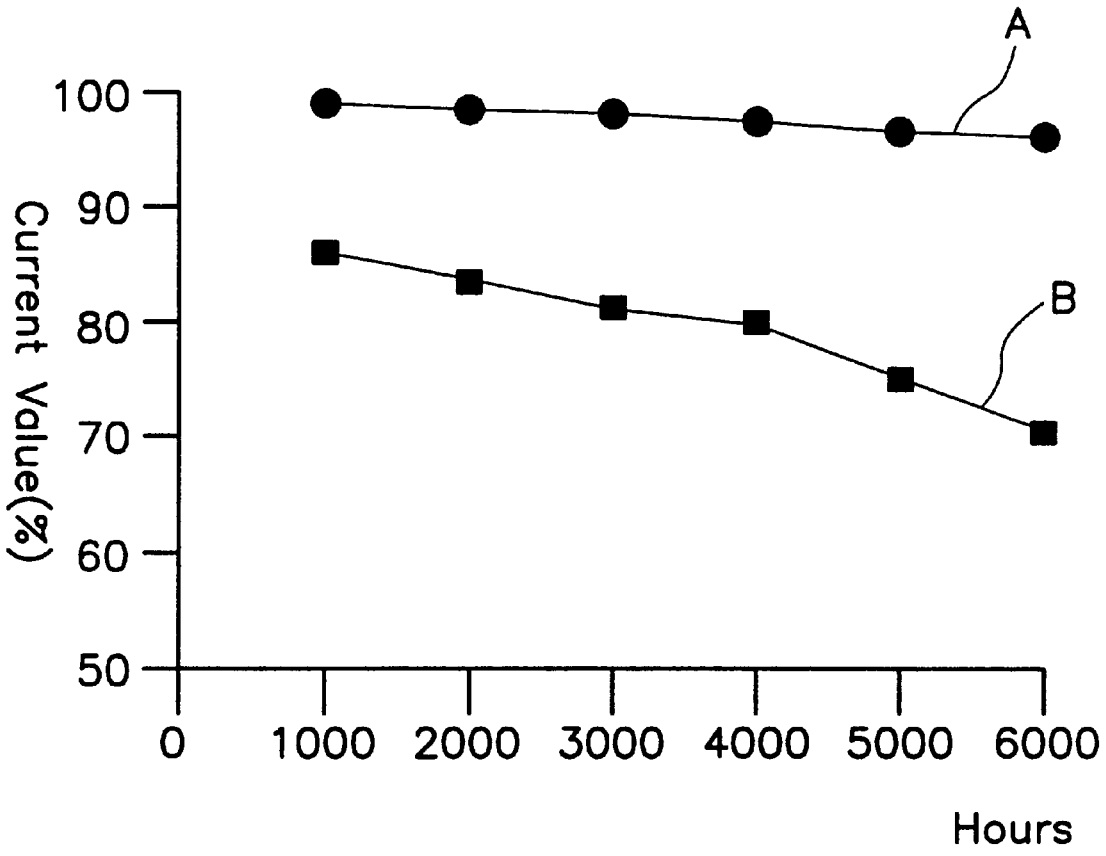
FIG. 4 is a diagram showing a life cycle characteristic of a cathode for an electron gun in accordance with the present invention.
Figure 5:
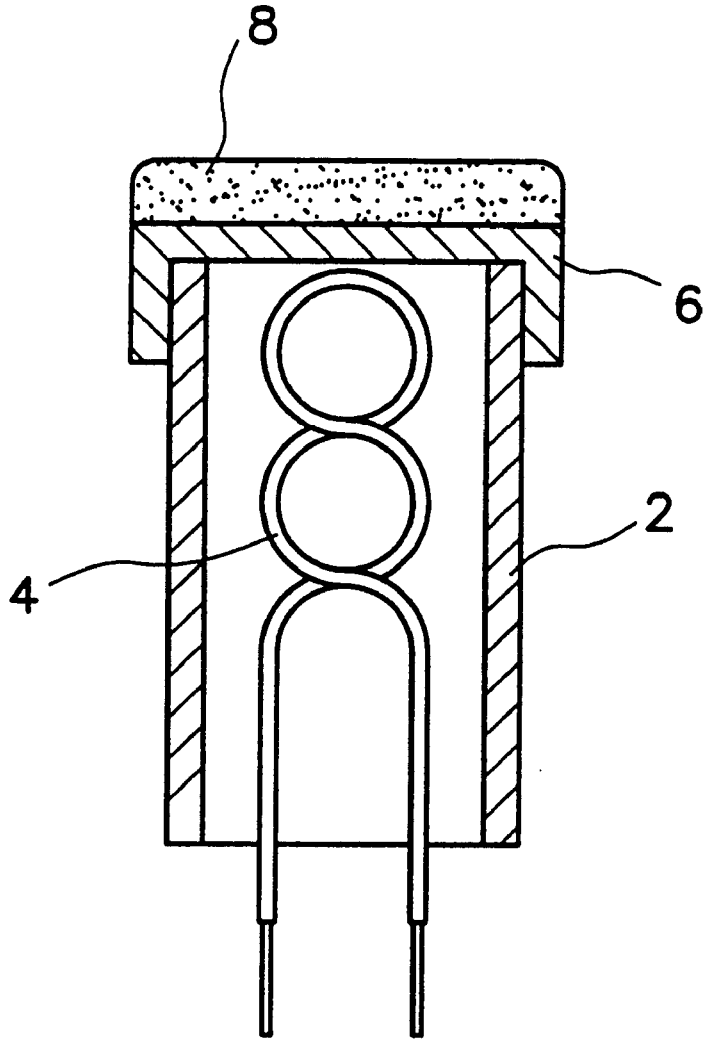
FIG. 5 is a sectional view of a conventional cathode for an electron gun.
Figure 6:
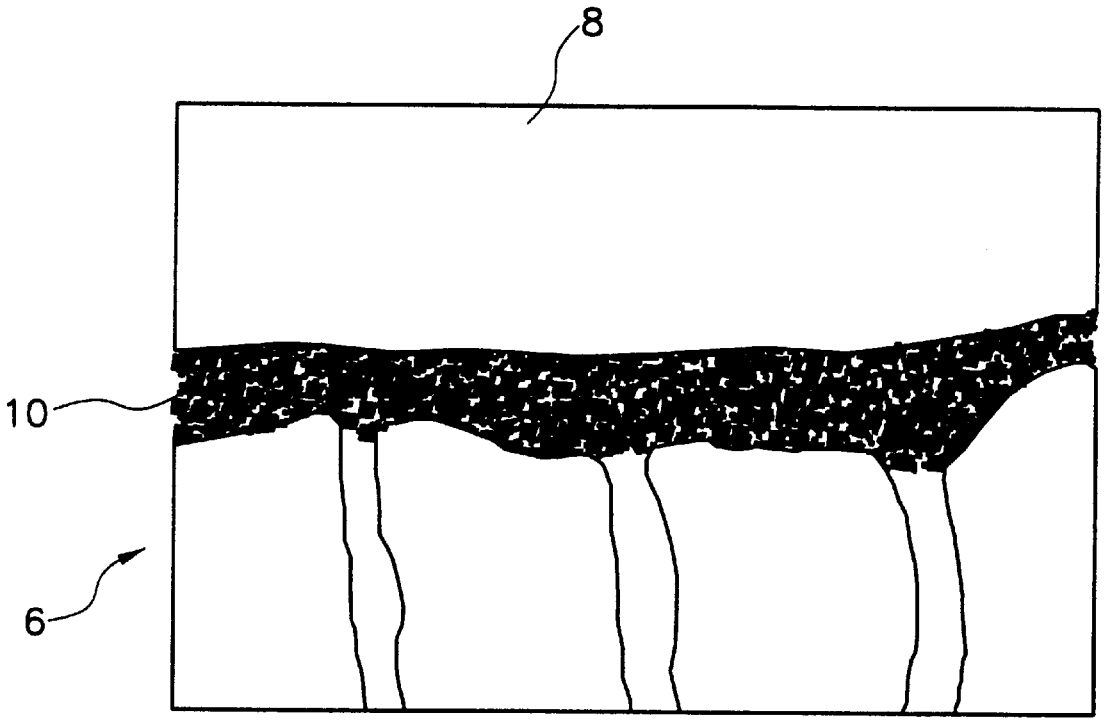
FIG. 6 is an enlarged sectional view of a conventional cathode for an electron gun.

FIG. 4 shows a result of testing the life cycle characteristic of the cathode for the electron gun according to the present embodiment.

In FIG. 4, A shows the life cycle of the cathode according to the present embodiment comprising the metal layer 12 of which the thickness is 400~1,200 Å, the electron emitting material layer 8 on the upper side of the metal layer 12, and the second electron emitting material layer 80 composed of carbonate containing 0.5 weight % of La—Mg compound. B shows the conventional cathode.

The test of life cycle is performed by measuring the decreasing amount of the electron emitting current while continuously operating for 6,000 hours. At this moment, 2,000~3,000 μA of current is applied to each cathode.

As shown in FIG. 4, the cathode for the electron gun according to the present embodiment is considerably improved in its life cycle in high current in comparison with the conventional art.

Using the cathode according to the present invention, 95% of first current value is maintained after operating for 6,000 hours in high current density.

In addition, according to the present embodiment, the maximum cathode current increases with the lapse of time.

According to the present invention, since the metal layer having fine grain formed between the base metal containing the reducing element and the electron emitting material layer composed of carbonate disperses the intermediate layer generated when generating free radical Ba atom to ensure the diffusion route of the reducing element steadily, free radical Ba atom can be continuously emitted.

In addition, since the inventive cathode comprises the electron emitting material layer containing both of La compound and Mg compound or La—Mg mixed compound, or further comprises the second electron emitting material layer containing both of La compound and Mg compound or La—Mg mixed compound, the evaporation of free radical Ba atom can be restrained.

As described above, since free radical Ba atom is continuously emitted and restrained to be evaporated due to the interaction of the metal layer and the electron emitting material layer or the second electron emitting material layer, the life cycle is improved even under high current density load of 2~3 A/cm$^2$.

In addition, the inventive cathode can be manufactured easily and at low price in comparison with the conventional impregnation cathode.

It will be apparent to those skilled in the art that various modifications and variations can be made in the cathode for the electron gun of the present invention without departing from the spirit or scope of the invention.

Thus, it is intended that the present invention cover the modifications and variations of this invention provided they come within the scope of the appended claims and their equivalents.

What is claimed is:

1. A cathode for an electron gun comprising:

a base metal mainly composed of nickel and containing one kind of reducing element at least;

a metal layer mainly composed of tungsten on the upper side of said base metal;

an electron emitting material layer containing alkaline earth metal oxide including barium at least on the upper side of said metal layer wherein said metal layer is formed of particles smaller than those of the base metal.

2. A cathode for an electron gun according to claim 1, wherein said metal layer is composed of tungsten, tungsten-nickel or zirconium-tungsten.

3. A cathode for an electron gun according to claim 1 or 2, wherein said metal layer is formed by spreading tungsten, tungsten-nickel, or zirconium-tungsten on the base metal and heating it.

4. A cathode for an electron gun according to claim 1, wherein said metal layer has thickness of 1,000~10,000 Å.

5. A cathode for an electron gun according to claim 4, wherein the entire thickness of the base metal, the metal layer, and the electron emitting material layer is within 50~200 μm.

6. A cathode for an electron gun according to claim 1, wherein said electron emitting material layer further containing both of lanthanum compound and magnesium compound or lanthanum-magnesium mixed compound.

7. A cathode for an electron gun according to claim 6, wherein said metal layer is composed of tungsten, tungsten-nickel or zirconium-tungsten.

8. A cathode for an electron gun according to claim 6 or 7, wherein said metal layer is formed by spreading tungsten, tungsten-nickel, or zirconium-tungsten on the base metal and heating it.

9. A cathode for an electron gun according to claim 6, wherein said metal layer has thickness of 1,000~10,000 Å.

10. A cathode for an electron gun according to claim 9, wherein the entire thickness of the base metal, the metal layer, and the electron emitting material layer is within 50~200 μm.

11. A cathode for an electron gun according to claim 1 further comprising a second electron emitting material layer including both of lanthanum compound and magnesium compound or lanthanum-magnesium mixed compound in alkaline earth metal oxide containing barium at least on the upper side of said electron emitting material layer.

12. A cathode for an electron gun according to claim 11, wherein said metal layer is composed of tungsten, tungsten-nickel or zirconium-tungsten.

13. A cathode for an electron gun according to claim 11 or 12, wherein said metal layer is formed by spreading tungsten, tungsten-nickel, or zirconium-tungsten on the base metal and heating it.

14. A cathode for an electron gun according to claim 11, wherein said metal layer has thickness of 1,000~10,000 Å.

15. A cathode for an electron gun according to claim 14, wherein the entire thickness of the base metal, the metal layer, the electron emitting material layer, and the second electron emitting material layer is within 50~200 $\mu$m.

* * * * *